United States Patent [19]

Avila, Jr.

[11] 3,933,097

[45] Jan. 20, 1976

[54] DEVICE TO DETERMINE EFFECTIVE TARGET SIZE FOR FIXED ANGLE FUZES

[75] Inventor: Louis J. Avila, Jr., Costa Mesa, Calif.

[73] Assignee: The United States of America as represented by the Secretary of the Navy, Washington, D.C.

[22] Filed: Jan. 4, 1968

[21] Appl. No.: 697,558

[52] U.S. Cl. ..... 102/70.2 P

[51] Int. Cl.[2] ..... F42C 13/00

[58] Field of Search ..... 102/70.2 P; 343/7 PF, 9, 343/12

[56] References Cited

UNITED STATES PATENTS

| | | | |
|---|---|---|---|
| 3,046,892 | 7/1962 | Cosse et al. | 102/70.2 P |
| 3,129,424 | 4/1964 | Rabinow | 102/70.2 P |

*Primary Examiner*—Verlin R. Pendegrass
*Attorney, Agent, or Firm*—Richard S. Sciascia; Joseph M. St.Amand; T. M. Phillips

[57] ABSTRACT

A system using two concentric fuzing beams in warhead implementation to measure the effective length of the target relative to the missile along the trajectory to prevent drop out of small targets.

2 Claims, 2 Drawing Figures

LOUIS J. AVILA, JR
INVENTOR.
BY T. M. Phillips
J. M. St. Amand
ATTORNEYS

LOUIS J. AVILA, JR
INVENTOR.

BY T. M. Phillips
J. M. St. Amand
ATTORNEYS

DEVICE TO DETERMINE EFFECTIVE TARGET SIZE FOR FIXED ANGLE FUZES

BACKGROUND

The present invention relates to fixed angle fuzes and more particularly to fixed angle fuzes which arm on the drop out of small targets. In fuzing systems where two concentric fixed conical detection beams have been used, the warhead is detonated either by loss of the target signal from the fore beam or by the elapsing of the time delay based on the relative missile-target velocity initiated upon detection in the aft beam. As a result, targets will normally drop out and the time delay equation need only be optmized for large targets. These systems lack the means for optimizing the time delay for different size targets.

SUMMARY

The present invention provides a means for determining range to the targets by optimizing the time delay of the time delay equation. This is done by utilizing information already present from the missile guidance system. The effective length of the target is computed to determine the appropriate time delay Many of the attendant advantages of this invention will become readily appreciated as the same becomes better understood by reference to the following detailed description when considered in connection with the accompanying drawings wherein.

Figure 1:
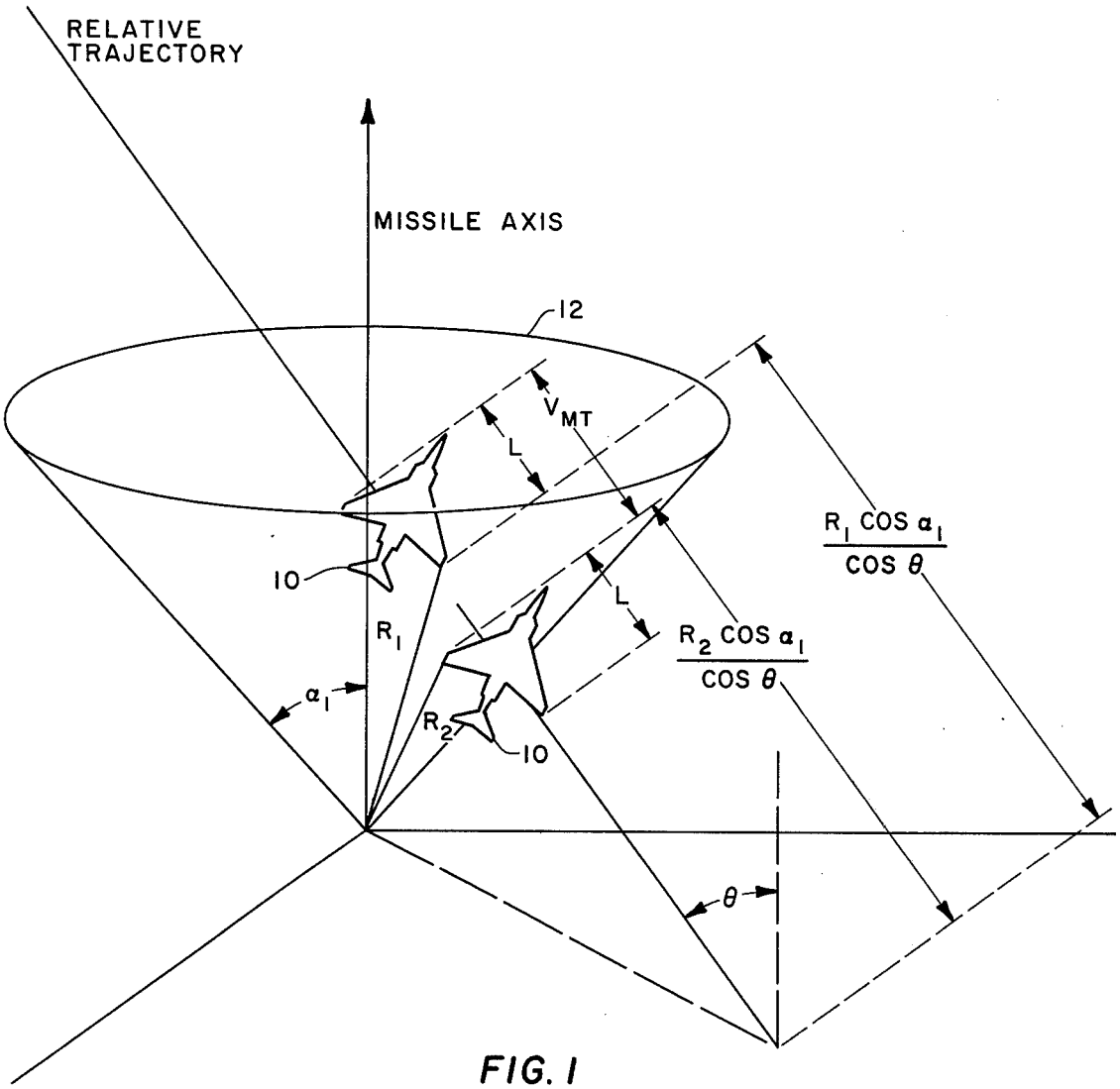
FIG. 1 is a graph showing the geometry involved in target detection and dropout in the fore beam of a missile target detecting device.

As shown in FIG. 1, the equation for determining the length of target 10 is:

$$L = V_{MT}(t_2 - t_1) - \frac{R_1 \cos \alpha_1 - R_2 \cos \alpha_2}{\cos \theta}$$

where

- $V_{MT}$ is relative missile target velocity supplied as a voltage level at terminal 20 (FIG. 2) from the missile guidance;
- $\theta$ is the long range line of sight angle supplied as a voltage at terminal 30 (FIG. 2) from the missile guidance;
- $\alpha_1$ and $\alpha_2$ are the polar angles defining the leading and trailing edges of the detection cone 12 respectively and hence are constant;
- $R_1$ is the range at which initial target detection occurs on the leading edge of fuze detection cone 12 and is supplied as a voltage to terminal 32 (FIG. 2) from the missile guidance;
- $R_2$ is the range at which target dropout occurs on the trailing edge of fuze detection cone 12 and is supplied as a voltage to terminal 34 (FIG. 2) from the missile guidance;
- $t_1$ is the time at which first detection occurs at $R_1$ and a pulse is received from the missile guidance at terminal 36;
- $t_2$ is the time at which target dropout occurs at $R_2$ and a pulse is received from the missile guidance at terminal 36.

By referring to FIG. 1, it can be seen that $V_{MT}(t_2-t_1)$ is the distance a given point on target 10 moves parallel to the relative trajectory during the time the target 10 is in the fore beam 12. This distance must be equal or greater than the projected length of target 10 on the relative trajectory. If target 10 only has extent along the relative trajectory, the target length, L, is equal to $V_{MT}(t_2-t_1)$. If the target also has extent normal to the relative trajectory, the target remains in beam 12 longer due to its extent normal to the relative trajectory.

$$\frac{(R_1 - R_2) \cos \alpha_1}{\cos \theta}$$

Figure 2:
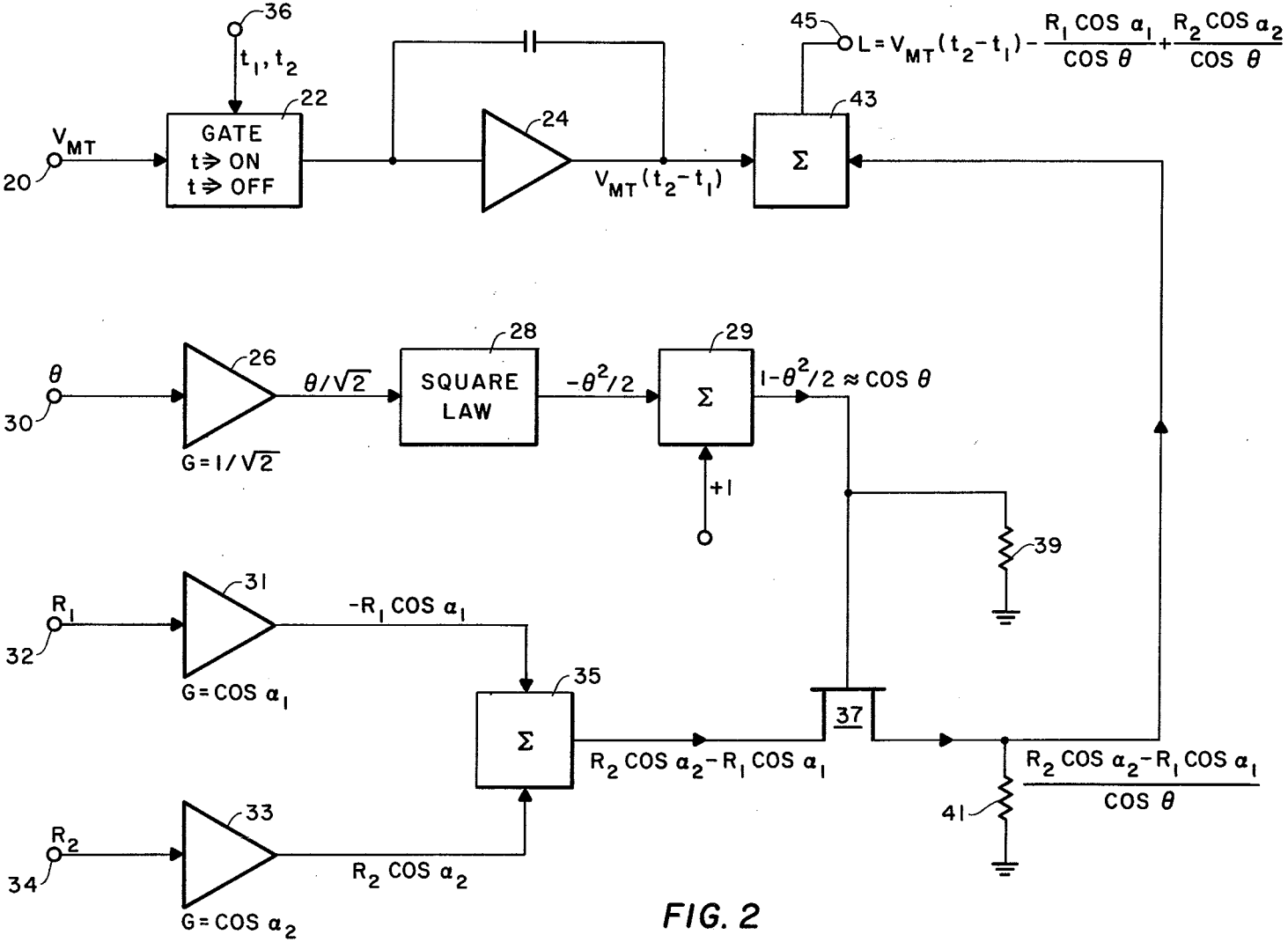
FIG. 2 is a circuit diagram utilized for generating a signal proportional to the effective target length.

Referring to FIG. 2 the $V_{MT}$ voltage received at terminal 20 is fed to gate circuit 22 which is gated by the signals received at terminal 36. The gated output voltage from gate circuit 22 is amplified by integrating amplifier 24 and is proportional to $V_{MT}(t_2-t_1)$. The $\theta$ voltage received at terminal 30 is fed to a functional amplifier 26 having a gain of $1/\sqrt{2}$ which produces an output signal proportional to $\theta/\sqrt{2}$. This signal is fed into a square law circuit 28 which produces an output signal proportional to $-\theta^2/2$. The output signal from square law circuit 28 is combined in summing circuit 29 with a voltage having a relative value of one to provide an output signal of $$1 - \frac{\theta^2}{2}$$

which is approximately equal to $\cos \theta$. The two range voltages, $R_1$ and $R_2$ received at terminals 32 and 34 are respectively fed through functional amplifiers 31 and 33 to produce output signals $-R_1 \cos \alpha_1$ and $R_2 \cos \alpha_2$ and are combined in summing circuit to produce a signal proportional to $R_2 \cos \alpha_2 - R_1 \cos \alpha_1$. The signal out of summing circuit 35 is coupled to a field effect transistor 37 where it is controlled by the signal out of summing circuit 29 to produce the signal $$\frac{R_2 \cos \alpha_2 - R_1 \cos \alpha_1}{\cos \theta}.$$

Resistors 39 and 41 are to provide the proper bias and load respectively. The signal from the field effect transistor 37 is combined in summing circuit 43 with the output signal from integrating amplifier 24 to produce the desired output signal at terminal 45 which is proportional to the target length.

What is claimed is:

1. A system for determining the effective target size in a guided missile-target encounter, the combination comprising:

a. gate circuit means having a first input adapted to receive a voltage representing the closing velocity between the missile and target, a second input adapted to receive gating pulses and having an output, b. a first function generating means having an input adapted to receive a voltage proportional to the target long range line-of-sight angle and providing an output signal proportional to the cosine of the target long range line-of-sight angle, c. a second function generating means having a first input adapted to receive a voltage proportional to the missile to target range upon the first detection of the target and a second input adapted to receive a voltage proportional to the missile to target range upon loss of the detection of the target for generating an output signal proportional to the difference in missile to target range along the relative trajectory between the missile and target, d. signal adding circuit means having a first input coupled to the output of said first function generating means and a second input coupled to the output of said second function generating means for providing an output signal which is proportional to the difference in range signal divided by the output signal from said first function generating means, e. summing circuit means having a first input coupled to the output of said signal adding circuit means and having a second input coupled to the output of said gate circuit means for providing an output signal proportional to the effective length of the target.

2. The system of claim 1 wherein said signal adding circuit means includes a field effect transistor having its base coupled to the output of said first function generating means whereby the difference in range voltage is modified to provide a difference in range divided by the output signal from said function generating means.

* * * * *